US007275277B2

(12) United States Patent
Moskovich et al.

(10) Patent No.: US 7,275,277 B2
(45) Date of Patent: Oct. 2, 2007

(54) FLEXIBLE TOOTHBRUSH HEAD

(75) Inventors: Robert A. Moskovich, East Brunswick, NJ (US); Michael C. Rooney, Milburn, NJ (US)

(73) Assignee: Colgate-Palmolive Company, New York, NY (US)

( * ) Notice: Subject to any disclaimer, the term of this patent is extended or adjusted under 35 U.S.C. 154(b) by 610 days.

(21) Appl. No.: 10/672,815

(22) Filed: Sep. 26, 2003

(65) Prior Publication Data

US 2005/0066462 A1 Mar. 31, 2005

(51) Int. Cl.
*A46B 9/04* (2006.01)

(52) U.S. Cl. ..... 15/167.1; 15/201; 300/21

(58) Field of Classification Search ..... 15/167.1, 15/201; 300/21
See application file for complete search history.

(56) References Cited

U.S. PATENT DOCUMENTS

| | | | | |
|---|---|---|---|---|
| 2,643,158 A | | 6/1953 | Baldanza | |
| 3,082,457 A | * | 3/1963 | Lucibello et al. | 15/167.1 |
| 4,633,542 A | * | 1/1987 | Taravel | 15/167.1 |
| 5,325,560 A | | 7/1994 | Pavone et al. | |
| 5,355,546 A | * | 10/1994 | Scheier et al. | 15/167.2 |
| 5,483,722 A | * | 1/1996 | Scheier et al. | 15/167.2 |
| 5,823,633 A | | 10/1998 | Weihrauch | |
| 6,088,870 A | * | 7/2000 | Hohlbein | 15/167.1 |
| 6,141,817 A | * | 11/2000 | Dawson | 15/167.1 |
| 6,779,851 B2 | * | 8/2004 | Bouchiere | 300/21 |
| 6,988,777 B2 | * | 1/2006 | Pfenniger et al. | 300/5 |
| 2002/0017003 A1 | | 2/2002 | Kramer et al. | |
| 2003/0084533 A1 | | 5/2003 | Gelder et al. | |
| 2003/0094848 A1 | | 5/2003 | Shia et al. | |

FOREIGN PATENT DOCUMENTS

| | | |
|---|---|---|
| DE | 845 933 | 6/1953 |
| DE | 893 491 | 10/1953 |
| EP | 0 613 636 A1 | 9/1994 |
| EP | 0 759 711 | 9/1998 |
| EP | 1 073 352 B1 | 9/2002 |
| WO | WO 99/55194 | 11/1999 |
| WO | WO 00/40115 A | 7/2000 |
| WO | WO 00/74917 A1 | 12/2000 |

* cited by examiner

*Primary Examiner*—Mark Spisich
(74) *Attorney, Agent, or Firm*—Michael J. Wallace, Jr.

(57) ABSTRACT

A head for use with a toothbrush and method for forming the same, comprising an outer perimeter portion formed of a rigid material. The rigid material is adapted to allow the head to be sonically welded. The head also comprises a tuft field positioned within the outer perimeter portion. The tuft field is formed of a flexible elastomer. The tuft field defines one or more apertures to receive one or more bristle tufts. The head is sonically welded into place in the toothbrush.

15 Claims, 2 Drawing Sheets

FLEXIBLE TOOTHBRUSH HEAD

BACKGROUND OF THE INVENTION

1. Field of the Invention

Figure 1:
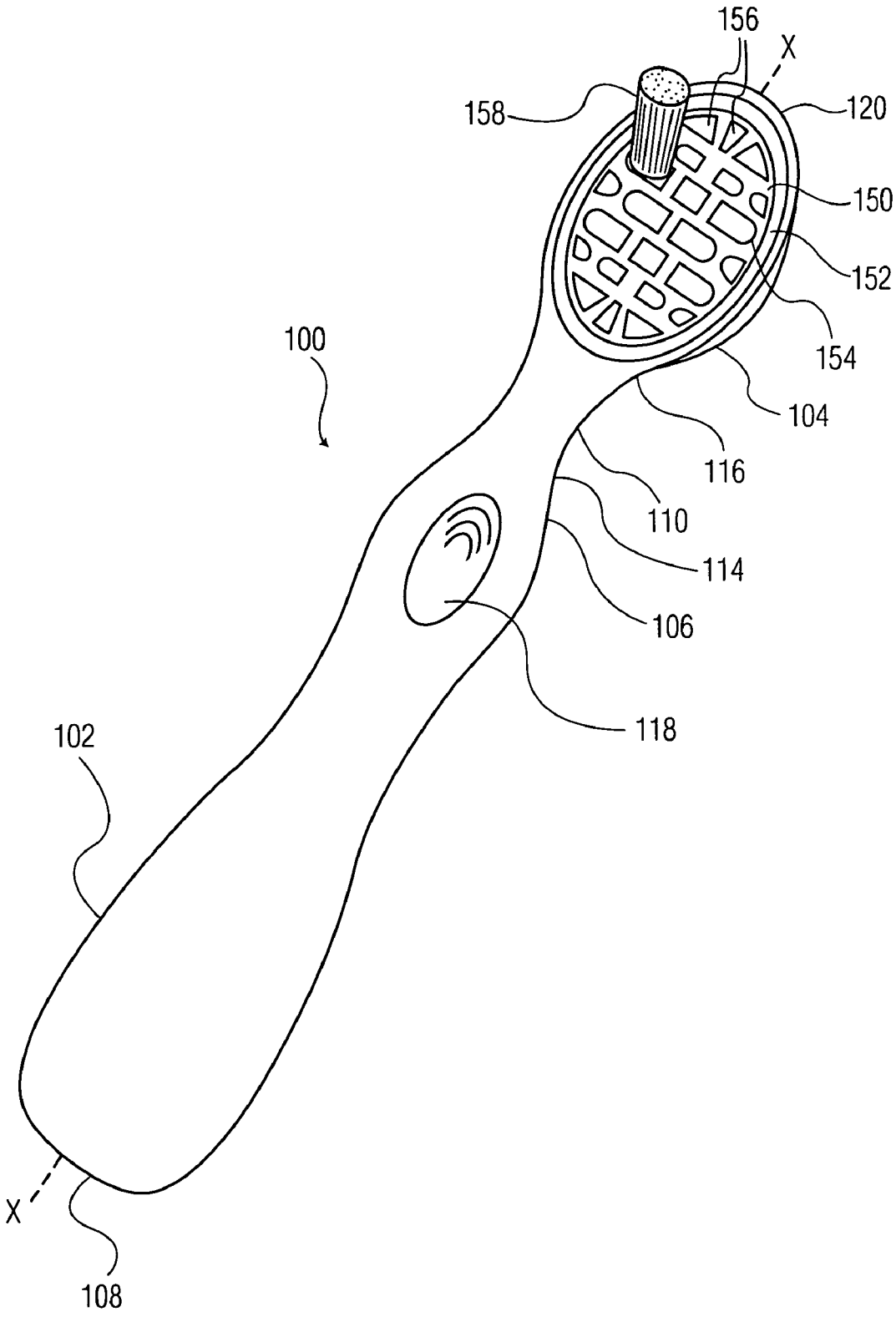

The present invention relates to toothbrushes, and more particularly, to a toothbrush being formed using an Anchor Free Tufting (AFT) process.

2. Discussion of Related Art

Toothbrushes provide many oral hygiene benefits. For example, toothbrushes remove plaque and food debris to help avoid tooth decay and disease. They remove stained pellicle from the surface of each tooth to help whiten the teeth. Also, the bristles combined with the brushing motion massage the gingival tissue for stimulation and increased health of the tissue.

A toothbrush head should provide both proper support for the bristles, and be flexible enough during use to allow the bristles to conform to the shape of a user's mouth or teeth. Additionally, construction techniques should be inexpensive, versatile and consistent.

In an attempt to meet these criteria, a process known as "Anchor Free Tufting" ("AFT") has been used in the formation of toothbrush heads. In such an AFT process, a head plate for holding toothbrush bristles, and for eventual insertion into a toothbrush body, is typically formed of a rigid plastic that is conducive to sonic welding. The head plate is formed with a solid perimeter and defines a field of variously shaped and sized holes within this perimeter. Fibers that are to form the tufts are then placed in the holes in the field of the head plate, and the backs of the tufts are melted together to fix their position relative to one another.

The tufted head plate is then inserted into a predefined receiving portion of the head portion of a toothbrush handle and is sonically welded into place. The brush is then end-rounded and packaged for sale as a traditional toothbrush.

However, this manufacturing process results in a toothbrush with a very rigid head that does not easily conform to the physical characteristics of a user when brushing. Therefore, it would be desirable to provide a toothbrush that can be conveniently manufactured by the above process, but provides the desired flexibility of the head of the toothbrush during use.

SUMMARY OF THE INVENTION

To improve a user's overall brushing experience, the inventors of the present invention have determined a softer, flexible head would be desired for use by a user. Such a head would flex under normal brushing conditions. The above AFT process could still be used to fix the relative positions of the bristles, and therefore provide a commercially appealing toothbrush. However, the inventors of the present invention have determined that such a head plate formed of elastomeric material is unable to be sonically welded to the head portion of the handle. This is because the elastomeric material absorbs and dissipates the vibrational energy imparted to the head plate during sonic welding.

Therefore, in order to overcome this drawback, the present invention is directed to a head plate for a toothbrush formed of two materials. A first rigid material is used to form the perimeter portion of the head plate. Such a material, such as for example polypropylene, is easily sonically welded. The tuft field is formed of a flexible elastomer (preferably having a hardness of 90 Shore A or less) that allows the field, and therefore the head plate and bristles to move or flex under the pressure of normal brushing. Thus, such a head plate is able to flex, thus allowing the tuft field and bristles to move under normal brushing conditions, while providing a perimeter of structural rigidity that is able to be sonically welded.

According to another embodiment of the present invention, a method for forming a head for use with a toothbrush is provided, comprising the steps of forming an outer perimeter portion of a rigid material, said rigid material being adapted to allow said head to be sonically welded; positioning a tuft field within said outer perimeter portion, said tuft field being formed of a flexible elastomer, said tuft field defining one or more apertures to receive one or more bristle tufts; placing a bristle tuft within at least one corresponding aperture in said tuft field; melting a portion of bristles in said bristle tuft to secure said bristle tuft in said aperture in said tuft field; and sonically welding said tuft field into place in said toothbrush.

Other features and advantages of the present invention will be apparent from the foregoing detailed description when read in conjunction with the accompanying drawings.

The invention accordingly comprises the several steps and the relation of one or more of such steps with respect to each of the others, and the apparatus embodying features of construction, combination(s) of elements and arrangement of parts that are adapted to effect such steps, all as exemplified in the following detailed disclosure, and the scope of the invention will be indicated in the claims.

BRIEF DESCRIPTION OF THE DRAWING FIGURES

Figure 2:
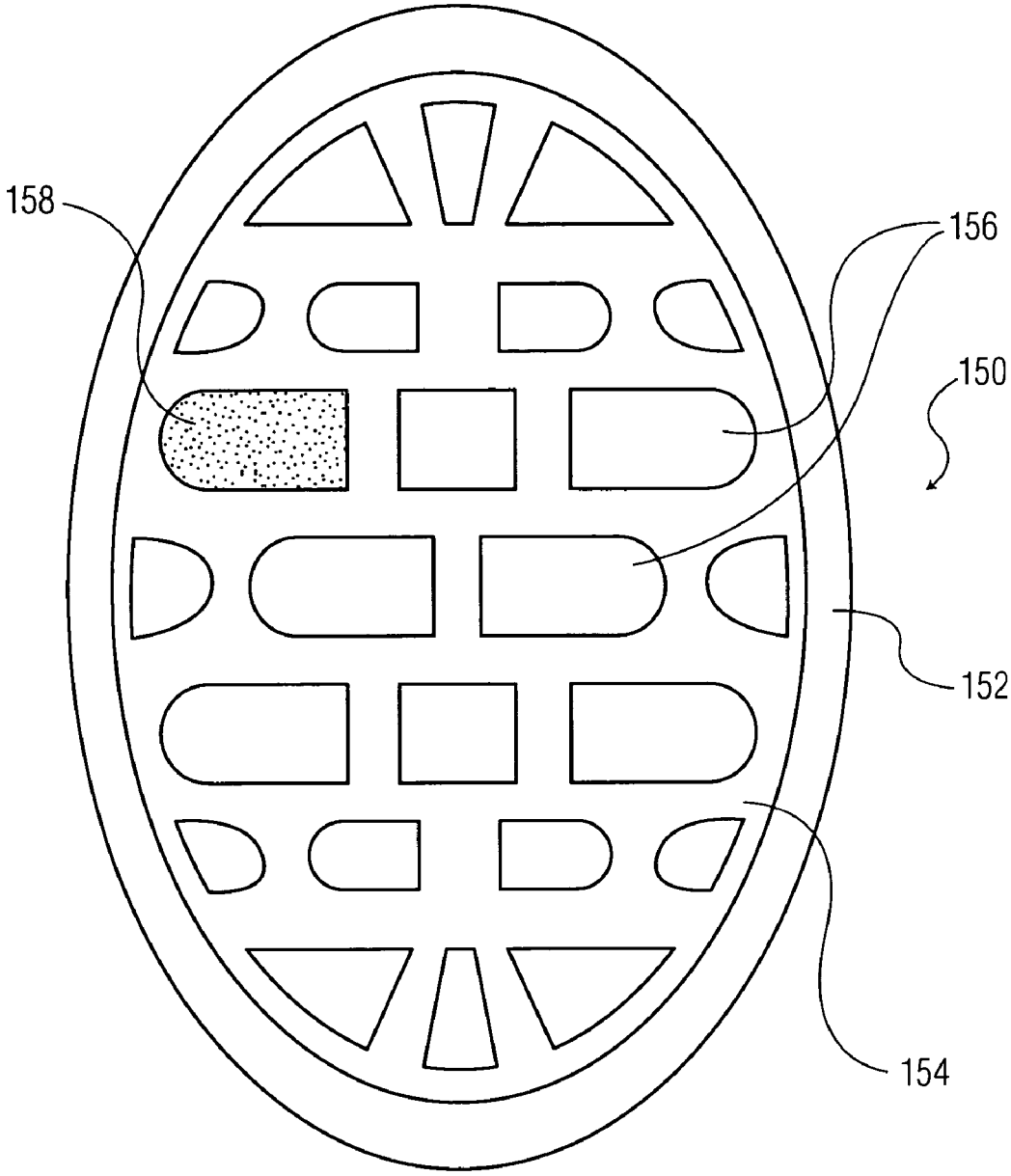

For a more complete understanding of the invention, reference is made to the following description and accompanying drawings, in which:

FIG. 1 is a perspective view of a toothbrush including a head constructed in accordance with a preferred embodiment of the invention; and FIG. 2 is a top plan view of the head of FIG. 1.

DETAILED DESCRIPTION OF THE PREFERRED EMBODIMENT

Referring to FIGS. 1 and 2, an exemplary toothbrush including a head plate according to the invention is illustrated and generally indicated at 100.

Toothbrush 100 includes a handle 102 at a proximal end thereof, and a brush section 104 that is defined by a neck 110 that terminates in a head 120 at a distal end of toothbrush 100. Handle 102 has a free proximal end 108 and an opposite neck end 106. Neck 110 generally includes a first end 114 and a second end 116 with first end 114 being located at neck end 106 of handle 102 and the second end 116 being located at head 120. In other words, neck 110 is the portion of toothbrush 100 that extends between handle 102 and head 120. Head 120 is preferably generally aligned with the longitudinal axis x-x of toothbrush 100.

Neck 110 and handle 102 may be constructed as a unitary member by forming neck 110 integral to handle 102 at neck end 106 of handle 102, or may be formed detachable from handle 102 at the neck end 106. In accordance with this detachable embodiment, the combined neck 110 and head 120 can be removed from handle 102 to permit cleaning, servicing and/or interchanging of either handle 102 or the combined neck 110 and head 120 (brush section 104). When neck 110 is formed to be detachable from handle 102, first neck end 114 preferably includes a connector linkage (not shown) that is adapted to be detachably joined to handle 102 using traditional techniques. It will also be appreciated that the point of detachment may be between head 120 and neck 110 such that head 120 is of a refill head type.

It will further be appreciated that the illustrated shapes of handle 102 and neck 110 are merely exemplary in nature and handle 102 and/or neck 110 can be formed to have any number of shapes. Preferably, the shapes of handle 102 and neck 110 are ergonomically pleasing to a user of toothbrush 100 and provide a toothbrush that is easily gripped and held and easily manipulated by a user. For example, handle 102 may include a slightly recessed finger section 118 which is formed on handle 102. The recessed finger section 118 is designed to receive the thumb of one hand to thereby assist a user in proper placement of toothbrush 100 in a user's hand. Recessed finger section 118 may include ribs or another type of roughened surface to assist a user in gripping toothbrush 100 at recessed finger sections 118. Of course other patterns for providing recessed finger sections may be employed The head plate for the bristles is formed with a solid perimeter and defines a field of variously shaped and sized holes within this perimeter. Fibers that are to form the tufts are then placed in the holes in the field of the head plate, and the backs of the tufts are melted together to fix their position relative to one another.

The tufted head plate is then inserted into a predefined receiving portion of the head portion of a toothbrush handle and is sonically welded into place. The brush is then end rounded and packaged for sale as a traditional toothbrush.

As is shown in FIGS. 1 and 2 of the present invention, a head plate 150 is provided, and is fixed to head 120 of toothbrush 100, preferably by sonic welding, although any other appropriate attachment technique may be employed. Head plate 150 is formed of at least two materials. A first rigid material is used to form the perimeter portion 152 of the head plate. Such a material, such as for example polypropylene, is easily sonically welded. A tuft field 154 is formed of a flexible elastomer (preferably having a hardness of 90 Shore A or less).

A process known as "Anchor Free Tufting" (AFT) is used in the formation of head 150. In such an AFT process, head plate 150 is used for holding toothbrush bristles in their proper orientation. When the bristles are placed in their proper orientation through the corresponding holes in the head plate 150, the head plate 150 is placed in the head plate cavity formed in the front face of the head section 104 of the brush, and for insertion into a toothbrush.

As is best shown in FIG. 2, head plate 150 is formed with a solid perimeter and defines a field of variously shaped and sized apertures or holes 156 within the flexible elastomer tuft field 154. Fibers that are to form one or more bristle tufts 158 are then placed in the holes in field 154 of head plate 150, and the backs of tufts 158 are melted together to fix their position relative to one another. Thus, such a head plate is able to flex, thereby allowing the tuft field and bristles to move under normal brushing conditions, while providing a perimeter of structural rigidity that is able to be sonically welded. Therefore, the head plate and bristles move or flex under the pressure of normal brushing. While bristles 158 are shown, elastomeric members may also be used in place of these tufts. Furthermore, while a particular tuft field pattern is shown, any desirable tuft field pattern may be employed. Furthermore, the bristle material need not be the same for all of the tufts, and indeed varying materials for performance color or indication of life remaining in the brush head, may be used exclusively, or in combination as desired.

The toothbrush according to the various embodiments disclosed herein can be made from any number of materials that are suitable for use in oral care products, such as toothbrushes, etc. For example, many of the components that are included in toothbrush are formed of plastic materials. Accordingly, the handle and head of the powered toothbrush may be molded from polyolefins such as polypropylenes and polyethylenes, polyamids such as nylons, and polyesters such as polyethylene terephthalate. Other suitable materials include polymethylmethacrylate, styrene acroylonitrate and cellulose esters, for example cellulose propionate.

When the tooth care elements are in the form of tufts of bristles, the bristles of can be made from a flexible material suitable for dental hygiene. Generally, materials suitable for bristles are polyamides such as nylon or polyesters such as polybutylene terephthalate. When the tooth care elements are in the form of elastomeric members, they can be made from any number of suitable elastomeric materials, such as a block copolymer. Preferred block copolymers include styrenes (for example styrene ethylene butadiene styrene, or styrene butadiene styrene), polyolefins (for example polypropylene/ethylene propylene diamine modified systems (i.e. synthetic rubber)), polyamides (for example polyamide (2 or polyamide 6), polyesters (for example polyester ester or polyether ester), polyurethanes (for, example polyesterurethane, polyetherurethane or polyesteretherurethane).

It will thus be seen that the objects set forth above, among those made apparent from the preceding description, are efficiently attained and, because certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A head for use with a toothbrush, comprising:

an outer perimeter portion formed of a rigid material, said rigid material being adapted to allow said head to be sonically welded; and a tuft field positioned within said outer perimeter portion and being formed of a flexible elastomer, said tuft field defining one or more apertures to receive one or more bristle tufts, said head being adapted to be sonically welded into place in a toothbrush.

2. The head of claim 1, wherein said rigid material comprises polypropylene.

3. The head of claim 1, wherein said flexible elastomer has a hardness of 90 shore A or less.

4. The head of claim 1, wherein during normal brushing conditions both said tuft field and said one or more bristle tufts move.

5. The head of claim 1, wherein during normal brushing conditions said tuft field flexes.

6. The head of claim 1, wherein said tuft field flexes upon the application of pressure thereto.

7. The head of claim 1, wherein said one or more bristle tufts are secured within each corresponding aperture in said tuft field by melting a portion of the bristles forming each of said bristle tufts.

8. The head of claim 7, wherein said bristle tufts are melted adjacent a back surface of said tuft field that is to be positioned facing said toothbrush.

9. A method for forming a head with a toothbrush, comprising the steps of:

forming an outer perimeter portion of a rigid material, said rigid Material being adapted to allow said head to be sonically welded; and positioning a tuft field within said outer perimeter portion, said tuft field being formed of a flexible elastomer, said tuft field defining one or more apertures to receive one or more bristle tufts;

placing a bristle tuft within at least one corresponding aperture in said tuft field;

melting a portion of bristles in said bristle tuft to secure said bristle tuft in said aperture in said tuft field; and sonically welding said outer perimeter portion into place in said toothbrush.

10. The method of claim 9, wherein said rigid material comprises polypropylene.

11. The method of claim 9, wherein said flexible elastomer has a hardness of 90 shore A or less.

12. The method of claim 9, wherein during normal brushing conditions both said tuft field and said one or more bristle tufts move.

13. The method of claim 9, wherein during normal brushing conditions said tuft field flexes.

14. The method of claim 9, wherein said tuft field flexes upon the application of pressure thereto.

15. The method of claim 9, wherein said bristle tufts are melted adjacent a back surface of said tuft field that is to be positioned facing said toothbrush.

* * * * *